US011478668B1

(12) United States Patent
Torbenson et al.

(10) Patent No.: US 11,478,668 B1
(45) **Date of Patent: *Oct. 25, 2022**

(54) MASK APPARATUSES AND APPROACH

(71) Applicant: RZ Industries LLC, Burnsville, MN (US)

(72) Inventors: Steve Gordon Torbenson, Lakeville, MN (US); Jordan Daniel Torbenson, Lakeville, MN (US)

(73) Assignee: RZ INDUSTRIES, LLC, Burnsville, MN (US)

( * ) Notice: Subject to any disclaimer, the term of this patent is extended or adjusted under 35 U.S.C. 154(b) by 89 days.

This patent is subject to a terminal disclaimer.

(21) Appl. No.: 16/593,574

(22) Filed: Oct. 4, 2019

Related U.S. Application Data

(63) Continuation of application No. 14/732,275, filed on Jun. 5, 2015, now Pat. No. 10,434,341.

(51) Int. Cl.

| | |
|---|---|
| ***A62B 23/02*** | (2006.01) |
| ***A62B 18/08*** | (2006.01) |
| ***A62B 18/00*** | (2006.01) |
| ***A62B 23/00*** | (2006.01) |
| ***A41D 13/11*** | (2006.01) |

(Continued)

(52) U.S. Cl.
CPC ..... *A62B 23/025* (2013.01); *A41D 13/11* (2013.01); *A41D 13/1107* (2013.01); *A41D 13/1138* (2013.01); *A41D 13/1161* (2013.01); *A62B 7/10* (2013.01); *A62B 18/00* (2013.01); *A62B 18/02* (2013.01); *A62B 18/025* (2013.01); *A62B 18/084* (2013.01); *A62B 23/00* (2013.01); *A62B 23/02* (2013.01); *A62B 9/04* (2013.01)

(58) Field of Classification Search
CPC .... A62B 7/00; A62B 7/10; A62B 9/00; A62B 9/04; A62B 18/00; A62B 18/02; A62B 18/025; A62B 18/08; A62B 18/084; A62B 23/00; A62B 23/02; A62B 23/025; A61M 16/00; A61M 16/06; A61M 16/0605; A61M 16/0683; A61M 16/0694; A61M 2016/0661; A41D 13/11; A41D 13/1107; A41D 13/1138; A41D 13/1161; A41D 13/1184

See application file for complete search history.

(56) References Cited

U.S. PATENT DOCUMENTS

| | | | |
|---|---|---|---|
| 3,097,642 | A | 7/1963 | Allan |
| 3,249,108 | A | 5/1966 | Louis |

(Continued)

FOREIGN PATENT DOCUMENTS

| | | | |
|---|---|---|---|
| WO | 1991005584 | A1 | 5/1991 |
| WO | 2011026515 | A1 | 3/2011 |
| WO | 2017063137 | A1 | 4/2017 |

*Primary Examiner* — Colin W Stuart
(74) *Attorney, Agent, or Firm* — Crawford Maunu PLLC

(57) ABSTRACT

Aspects of various embodiments herein may be implemented as follows. An apparatus has a material shell that conforms to a user's face, and a securing portion connected to the shell that may operate to secure a filter to the user's face with the filter covering the user's nose and mouth. A securing force may be applied to the filter via the first material portion in a direction toward the user's face, thereby sealing the filter around the user's nose and mouth. Various implementations involve elastic and other material that facilitate sealing of the filter around the user's nose and mouth.

21 Claims, 4 Drawing Sheets

(51) Int. Cl.

| | |
|---|---|
| ***A62B 7/10*** | (2006.01) |
| ***A62B 18/02*** | (2006.01) |
| *A62B 9/04* | (2006.01) |

(56) References Cited

U.S. PATENT DOCUMENTS

| | | | | |
|---|---|---|---|---|
| 3,768,100 | A | 10/1973 | Colman et al. | |
| 4,951,664 | A | 8/1990 | Niemeyer | |
| 5,131,399 | A | 7/1992 | Sciarra | |
| D340,317 | S | 10/1993 | Cole | |
| D413,166 | S | 8/1999 | Snow et al. | |
| 6,394,090 | B1 | 5/2002 | Chen | |
| 6,698,427 | B1 | 3/2004 | Clowers | |
| 6,805,124 | B2 | 10/2004 | Japuntich et al. | |
| 6,817,362 | B2 | 11/2004 | Gelinas et al. | |
| 7,044,127 | B1 | 5/2006 | Fernandez Decastro | |
| 7,810,493 | B2 | 10/2010 | Resnick | |
| 7,958,889 | B1 | 6/2011 | Fernandez-Decastro | |
| 8,807,134 | B2 | 8/2014 | Ho et al. | |
| 10,434,341 | B1 * | 10/2019 | Torbenson | A62B 18/00 |
| 2005/0061327 | A1 | 3/2005 | Martin et al. | |
| 2007/0044803 | A1 | 3/2007 | Xue et al. | |
| 2008/0034458 | A1 | 2/2008 | Ku | |
| 2008/0223370 | A1 | 9/2008 | Kim | |
| 2009/0320849 | A1 | 12/2009 | Biedermann | |
| 2010/0018533 | A1 | 1/2010 | Biedermann et al. | |
| 2010/0101584 | A1 | 4/2010 | Bledstein et al. | |
| 2011/0180078 | A1 | 7/2011 | McKinley | |
| 2012/0090615 | A1 | 4/2012 | Chen | |
| 2012/0247474 | A1 | 10/2012 | Torbenson | |
| 2014/0202469 | A1 * | 7/2014 | Smaller | A62B 23/025 128/863 |
| 2015/0034098 | A1 * | 2/2015 | Schumacher | A62B 23/025 128/863 |
| 2015/0047642 | A1 * | 2/2015 | Tucker | A62B 23/02 128/206.17 |
| 2015/0216241 | A1 | 8/2015 | Lee et al. | |
| 2016/0001101 | A1 * | 1/2016 | Sabolis | A62B 18/08 128/863 |
| 2016/0037836 | A1 * | 2/2016 | Tuan | A41D 13/1169 128/863 |
| 2016/0332008 | A1 * | 11/2016 | McAndrews | A62B 18/084 |
| 2017/0157436 | A1 | 6/2017 | Hosmer | |

* cited by examiner

MASK APPARATUSES AND APPROACH

FIELD

Aspects of various embodiments are directed to mask apparatuses and related approaches.

BACKGROUND

Masks are useful for a variety of applications, ranging from industrial to medical to recreational applications. For instance, industrial masks are often useful or required for certain applications, and can enhance worker safety. Medical masks can be important for ensuring that medical personnel are protected from exposure. Recreational masks can be useful for filtering dust and other particles.

While useful, many masks are uncomfortable to wear, difficult to fit, and may result in less than desirable protection. For instance, many disposable masks are general in size and shape and are difficult to properly conform to individual faces, such as to accommodate facial hair and other varied facial characteristics, which can result in an improper seal. An improper seal can permit passage of particulates, and can result in fogging of glasses (e.g., via improperly fitting nose pieces). These and other matters have presented challenges to the use and implementation of masks for a variety of applications.

SUMMARY

Various example embodiments are directed to masks, and mask apparatuses involving a mask shell, and their implementation.

In accordance with one or more embodiments, an apparatus includes a first material portion that conforms to a user's face, and a second securing portion that is connected to the first material portion and operates with the first material portion to secure a filter to the user's face with the filter covering the user's nose and mouth. For instance, with the filter positioned between the first material portion and the user's face, the second securing portion applies a securing force to the filter via the first material portion in a direction toward the user's face and thereby sealing the filter around the user's nose and mouth.

Various embodiments are further directed to an apparatus as above that further includes the filter. A variety of additional components are implemented in accordance with one or more embodiments, to facilitate alignment of the filter and securing of the filter to the user's face.

The above discussion/summary is not intended to describe each embodiment or every implementation of the present disclosure. The figures and detailed description that follow also exemplify various embodiments.

DESCRIPTION OF THE FIGURES

Various example embodiments may be more completely understood in consideration of the following detailed description in connection with the accompanying drawings, in which.

Figure 1:
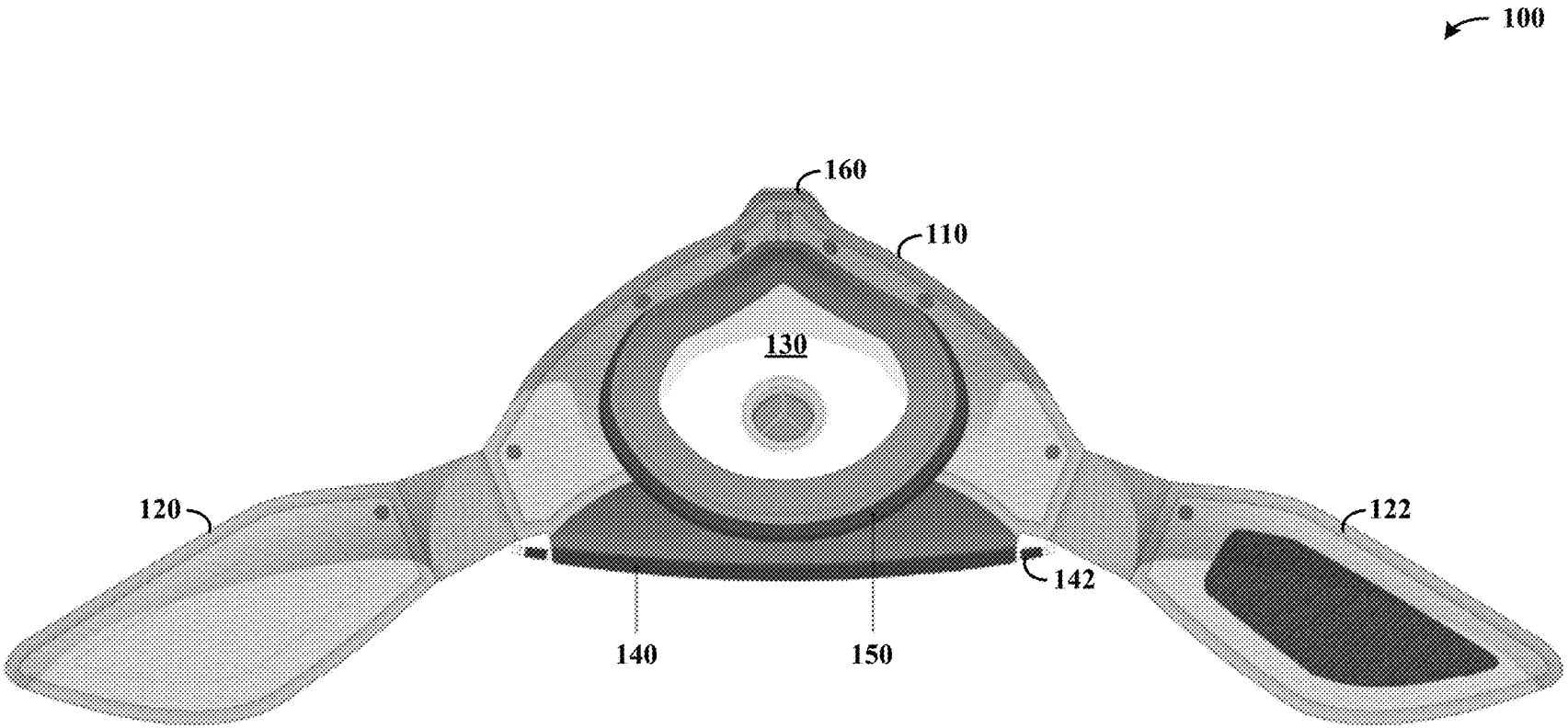
FIG. 1 shows a mask apparatus, as may be implemented in accordance with one or more embodiments.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

DETAILED DESCRIPTION

Aspects of the present disclosure are believed to be applicable to a variety of different types of apparatuses, systems and methods involving masks, and particularly involving replaceable masks with a shell-type approach that facilitates fitment of the replaceable mask. In certain implementations, aspects of the present disclosure have been shown to be beneficial when used in the context of disposable masks that can suffer from fitment problems such as those described above, with improved sealing around a user's face and related comfort. While not necessarily so limited, various aspects may be appreciated through a discussion of examples using such exemplary contexts.

According to various example embodiments, aspects of the present disclosure are directed to an apparatus and approach in which a user may place a mask on the inside of a shell. The shell and mask conform to one another and operate to secure the mask against the user's face, with the shell including one or more fasteners that couple to the user and provide a holding force that is translated through the shell to the mask. In some implementations, the shell covers the mask and allows air to pass through to the mask, and in other implementations the shell operates with the mask to secure the mask to a user's face while allowing a portion (e.g., a central portion) of the mask to remain exposed. This approach can assist in accurately conforming masks to a variety of different types of facial features, bone structure and sizes. This approach also facilitates the use of a replacement mask material (e.g., for disposable masks) while providing robust fitment via the reusable shell. Comfort, safety and convenience aspects can all be addressed in this regard, which can be particularly helpful with disposable masks in which low cost can be desirable.

In various embodiments, a flexible material is used to provide a shell (e.g., a frame), that conforms to a replaceable mask. The shell may include, for example, neoprene, mesh material, a moisture-wicking material, cotton material, and/or polyester material. The frame may include multiple openings via which a replaceable mask may be exposed, which can facilitate breathing through the replaceable mask. In some implementations, the shell operates to pass air though a mesh or perforated type structure, to the mask. The shell may have one, two or more straps that secure the shell and, when integrated therewith, a mask to a user. Such straps may include a head strap connected to the shell and/or other straps (e.g., via a hook-and-loop fastener or button). In further embodiments, a holding strap is included for loosely holding the shell around a user's neck while the shell is in an unsecured position (e.g., removed from the user's face).

In some embodiments, fitment and sealing of a shell and corresponding mask is carried out with a conforming component that draws the shell (and therein the mask) with a force against the user's face. In some embodiments, an elastic material extends around a user's nose and mouth and is operable to adjustably apply pressure in this context, providing and adjustable sealing force to the user's face. For instance, an elastic draw string having a rubber compression ring or a round elastic cord can be used to facilitate tensioning. The cord is secured, for example, using a tension ring or other component. In certain embodiments, elastic type material is integrated with the shell such that the elastic type material can be adjusted to accommodate masks of various sizes. Various embodiments employ a conforming component that applies an even, or nearly even, pressure along a path that encloses the user's nose and mouth, providing a seal between the mask and the user's face.

In some embodiments, a mask shell as characterized herein includes a deformable material that holds shape upon physical deformation, within the mask shell. For instance, a bendable aluminum piece of material can be sewn in the shell in an area that covers a user's nose when the shell is in place. The aluminum piece is bendable to conform the mask shell, and therein the mask, to the user's nose.

One or more embodiments employ elastic or other fitting/tightening components at target locations of the shell. In one embodiment, an elastic material is employed near a chin portion of the shell, to facilitate a tight seal around a user's chin. For instance, additional fabric may be applied at a chin region, relative to other portions of the shell, to facilitate the seal. In some embodiments, a strap is integrated with a chin region, for tightening the material at the chin.

In some implementations, an alignment component aligns masks to a shell as characterized herein. Such an alignment component may, for example, include a ridge or other structure that may be part of, or separate from, material that forms other portions of the shell. The alignment component operates to align removable masks relative to the shell, and facilitates proper fitment thereof (e.g., with an inner surface of the mask shell in contact with an outer surface of the filter).

A variety of accessories may be implemented to suit particular embodiments. In some embodiments, ear plugs, safety glasses, a storage pouch, or a light are attached to provide functionality. Certain embodiments employ additional material such as a bandana, dickey or neck scarf that can be useful in windy or cold weather environments. These components may be implemented with a variety of coupling or fastening approaches, such as hook-and-loop or button-type fasteners. A full-head balaclava may be incorporated for certain applications, which may alleviate the need for straps or fasteners.

A variety of masks may be implemented to suit a variety of applications. For instance, dust masks, chemical masks, medical masks and others can be implemented with a shell as discussed herein. These masks may be washable, disposable or usable over an extended period of time. Such masks may include, for example, those available from 3M Company of St. Paul, Minn.; Moldex of Culver City, Calif.; and Honeywell of Morristown, N.J. In addition, a variety of mask sizes can be employed with a common shell. For instance, the shell may be sized with an opening that accommodates various sizes of masks, in which the shell interfaces with each mask to provide a proper seal to the user's face.

In various embodiments, a shell as characterized herein includes a sealing mechanism that mitigates or prevents moisture from reaching a user's glasses or other eyewear. Such approaches may involve nose pieces and/or other conforming components that conform the shell and/or a mask therein to a user's face. This approach can provide a better seal than, for example, a relatively weak strap system as may be employed with disposable masks. Moreover, the mask may be desirably sealed over facial features, facilitating filtration.

Various embodiments are directed to a mask shell having power connectivity for powering accessories. Positive and negative terminals are located on one or more portions of the mask at which accessory attachment is desired, and coupled to a power source. In some implementations, the terminals are coupled to conductors that extend to a remote power source, such as a battery that is located in another portion of the mask. In certain embodiments, a battery is stored in a pouch integrated in a rear portion of the mask shell. The conductors may be implemented with a switch that can be used to power or remove power from an accessory coupled to the terminals. In various embodiments, a cover or covers are included and couple to the terminals, providing a cover when the terminals are unused. Such an approach may be implemented with snap-type terminals, with button covers that couple to the snap-type terminals.

In accordance with one or more embodiments, an apparatus includes a first shell-type portion that conforms to a user's face with a filter placed between the shell and the user. A securing portion, such as a flexible material and straps, is connected to the first shell-type portion and secures the filter to the user's face by applying a force to the shell-type portion (e.g., by securing straps around the back of the user's neck). The filter is thus pressured by the mask to the user's face, covering the user's nose and mouth. Various embodiments further include the filter, which may be essentially freely-moving relative to the shell.

In various implementations, the first shell-type portion applies the securing force along a path of an inner surface of the filter that is in contact with the user's face, with the securing force being about equal along an entire length of the path. This approach is useful, for example, to mitigate issues relating to mask filter placement and securing (e.g., by deforming the filter along a contour that surrounds the user's nose and mouth), to mitigate leaking. An elastic material may be implemented along the path or other interface between the shell-like material and the filter to enhance the fitment and securing. As the securing portion may include robust straps, these straps can aide coupling of the filter to the user (e.g., relative to disposable masks). In certain embodiments, the first shell-type material portion has a central opening in which the filter inserts, and in which a portion of an outer surface of the filter is uncovered and another portion of the outer surface of the filter is covered by the first material portion. An elastic material around the opening may be implemented to conform the filter to the mask and user's face. The second securing portion secures the first material portion against the outer surface of the mask and secures an inner surface of the mask to the user's face.

Certain embodiments employ a securing portion to seal against a bridge of the user's nose, and therein inhibit moisture exhaled from the user from fogging eyewear worn by the user. This approach may be implemented with an inner surface of the nose portion in contact with the user's nose, while the first material portion secures the filter with an inner surface of the filter being in contact with a portion of the user's nose below a portion of the bridge with which the nose portion is in contact.

Various approaches herein involve the use of a replaceable or disposable filter, which can otherwise move independently of a shell or first material as described above. A second securing portion secures an inner surface of the shell with an outer surface of the filter, with an inner surface of the filter being in contact with and secured to the user's face with a securing force applied.

In various implementations, a securing portion as noted herein applies a settable pressure upon a shell for securing a filter to a user's face under respective conditions in which the user has no facial hair and in which the user has facial hair, thereby forming a seal via different amounts of pressure in each of the respective conditions. In certain implementations, the securing portion includes a chin strap configured and arranged to apply the settable pressure. The securing portion thus may, for example, be integrated with the shell, and/or be implemented in separate components coupled to the shell (e.g., a chin strap being separate from straps that extend around a user's neck). Various elastic cords may be similarly implemented to apply a settable force along a path that surrounds the user's nose and mouth, such as with a compression ring that maintains the settable force.

Turning now to the Figures, FIG. 1 shows a mask apparatus 100, as may be implemented in accordance with one or more embodiments. The apparatus 100 includes a shell 110 that incorporates with straps 120 and 122 to secure a mask 130 to a user's head. The shell 110 can be implemented with a variety of materials and shapes, to suit particular embodiments. The straps 120 and 122 operate to secure to one another or another component on a user, applying a force to the mask 130 against the user's face via the shell 110.

The shell 110 can be implemented in a variety of manners. In some implementations, the shell is solid and covers an outer surface of the mask 130 (in the drawing as shown in FIG. 1, an inner surface of the mask is shown with an outer surface facing away). In other implementations, the shell 110 has one or more openings via which the outer surface of mask 130 may be exposed. In either implementation, an inner surface of the shell 110 operates to apply the aforementioned force against the mask 130 when the shell is coupled to a user's face via straps 120. In this context, the mask 130 may be independent from the shell 110 in an unsecured state, and be secured/pressed against a user's face in a secured state. In this context, a removable or disposable mask such as described above can be affixed around a user's nose and mouth to provide air filtration. The shell 110 operates to apply pressure to the mask, such as an even force around the user's nose and mouth that creates a seal.

One or more components shown in FIG. 1 can be implemented separately, or in combination, to suit various embodiments. Further, the apparatus 100 can be implemented with a variety of characteristics, such as those described herein. For instance, in some embodiments a securing foam or other material 140 is employed to enhance fitment to a user, such as to accommodate facial hair while maintaining a seal. A tensioning component 142 may further be employed to tension the material 140. Some embodiments involve material such as foam used at 150 to guide placement of the mask 130 relative to the shell 110. A nosepiece 160 can be implemented to enhance sealing of the shell 110 to the user, mitigating issues such as those relating to moisture escape that can fog eyewear.

Figure 2:
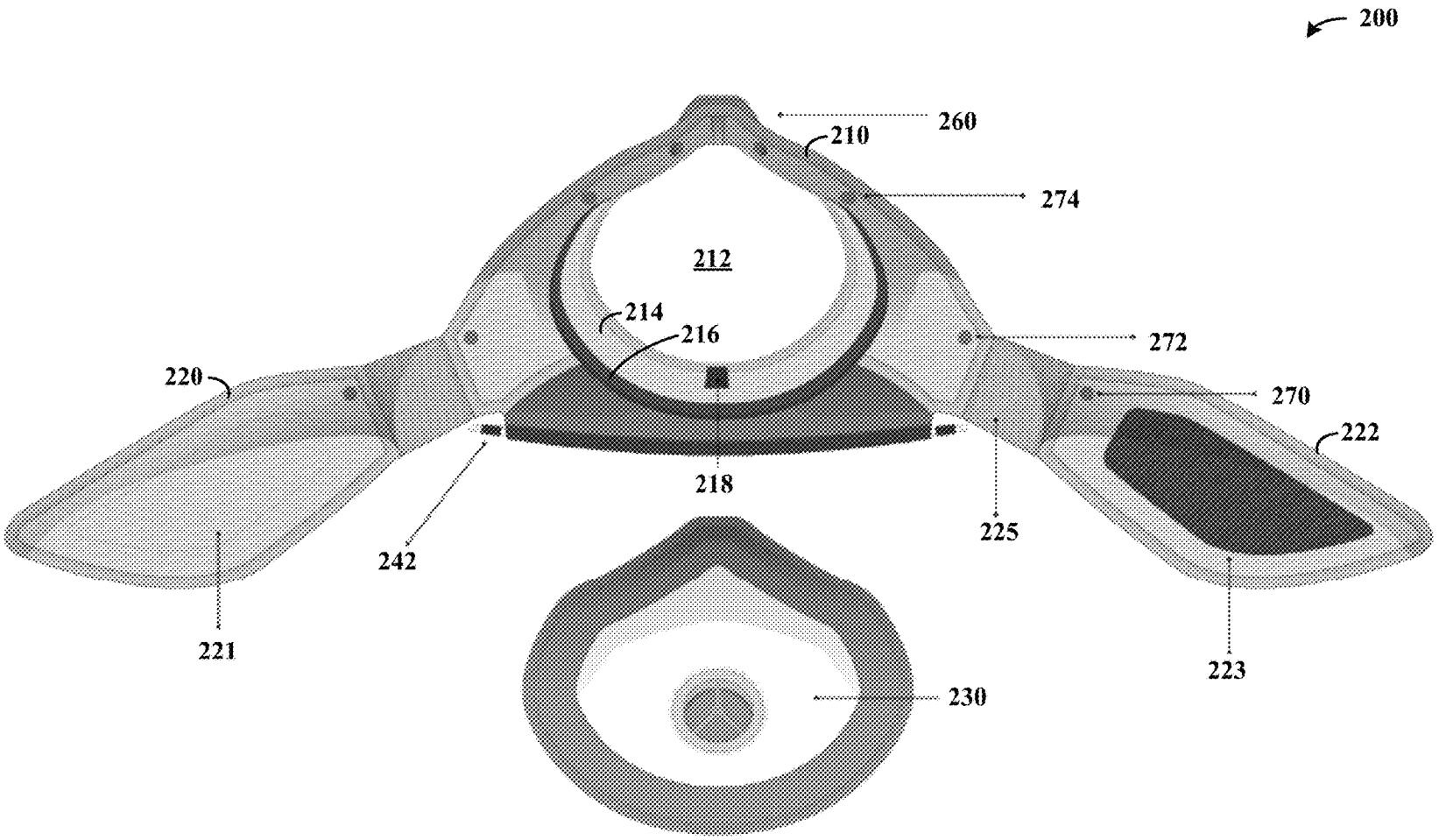
FIG. 2 shows a mask apparatus, as may be implemented in accordance with one or more embodiments.

FIG. 2 shows another mask apparatus 200, as may be implemented in accordance with one or more embodiments. The apparatus 200 may, for example, be implemented in accordance with the apparatus 100 shown in FIG. 1, and in this context various similar reference numerals are used for similar components (e.g., shell 210, straps 220 and 222, mask 230, tensioning component 242, and nose piece 260).

By way of example, the shell 210 is shown with an opening at 212 that accommodates mask 230. An inner surface of the shell 210 at region 214 interfaces with an outer surface of the mask 230 near an edge thereof, and applies a force (with the straps 220 and 222 engaged) that secures the mask against a user's face. Accordingly, region 214 of the shell 210 can be shaped to conform to the mask 230, with a portion of an outer surface of the mask being exposed via opening 212 when held in place. A guide 216, such as a foam guide, operates to align the mask 230 with the shell 210. A fastener 218, such as a hook, may be implemented to help secure the mask 230 to the shell 210 while the mask/shell combination is fitted to a user and secured via the straps 220 and 222.

A variety of additional components are shown in FIG. 2, one or more of which may be implemented with the apparatus 200. For instance, straps 220 and 222 may be secured to one another with hook-and-loop type fasteners 221 and 223 (one including hooks and the other loops), and may employ a stretchable material as shown at 225 to secure the shell to a user. A plurality of connectors can be implemented at various connection points, such as 270, 272 and 274, for connecting accessories such as earplugs, safety glasses and a head strap.

Figure 3:
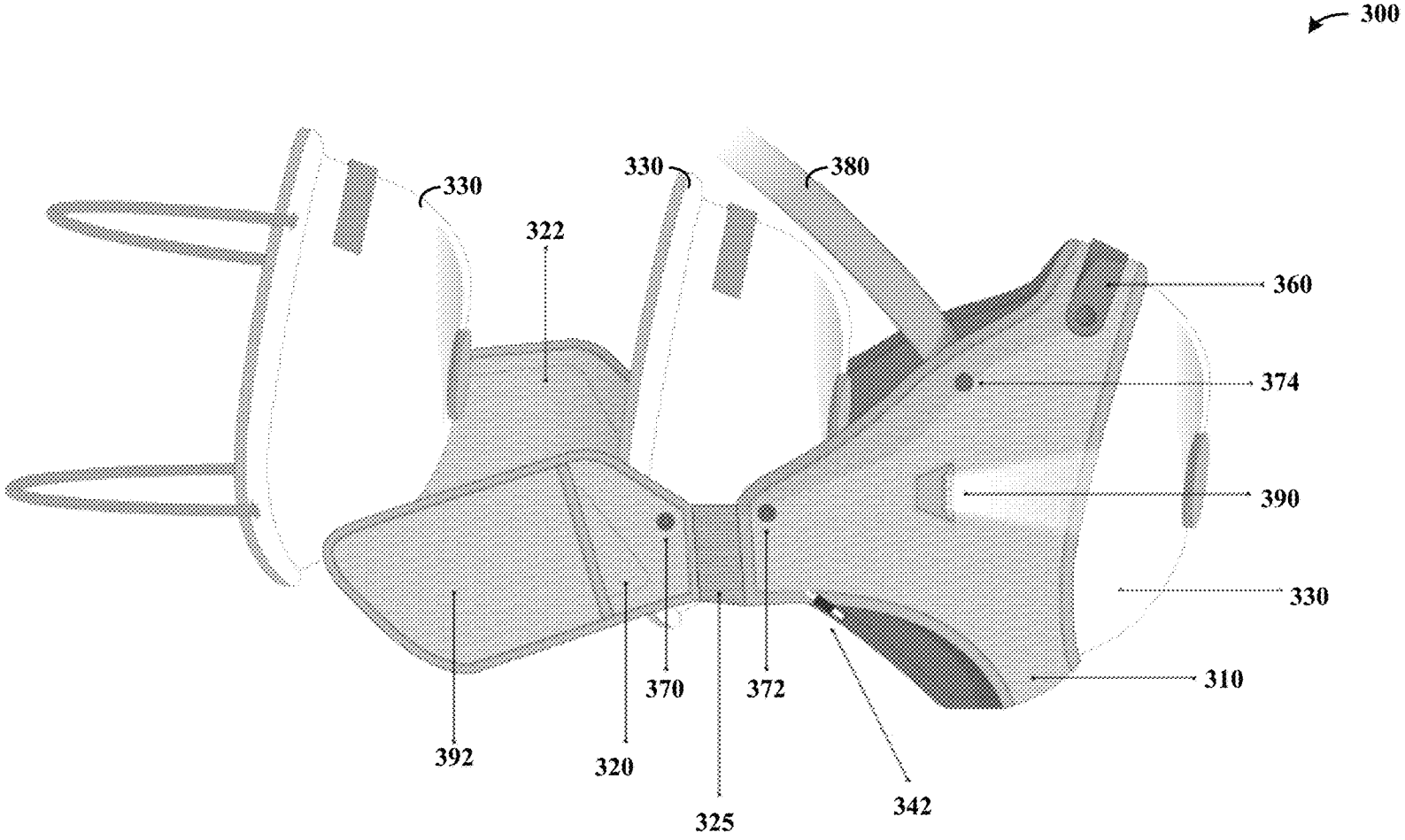
FIG. 3 shows a mask apparatus with insertion of a replaceable mask, in accordance with various embodiments.

FIG. 3 shows a mask apparatus 300 with insertion of a replaceable mask 330, in accordance with various embodiments. The apparatus 300 may be implemented in accordance with the apparatus 100 shown in FIG. 1 and/or with the apparatus 200 shown in FIG. 2. In this context various similar features are not described further in FIG. 3, but are understood as being implementable with the features described in FIGS. 1 and 2. Such features may include shell 310, nosepiece 360, a headstrap rivet 374, tensioning component 342, a stretchable component 325, straps 320 and 322, strap 380, ear plug rivet 370 and safety glasses rivet 372.

The apparatus 300 shows mask 330 at different locations as it is being installed or removed. The apparatus 300 may also be implemented with a light 390, which can be powered via a battery as may be kept in a storage pouch 392.

Figure 4:
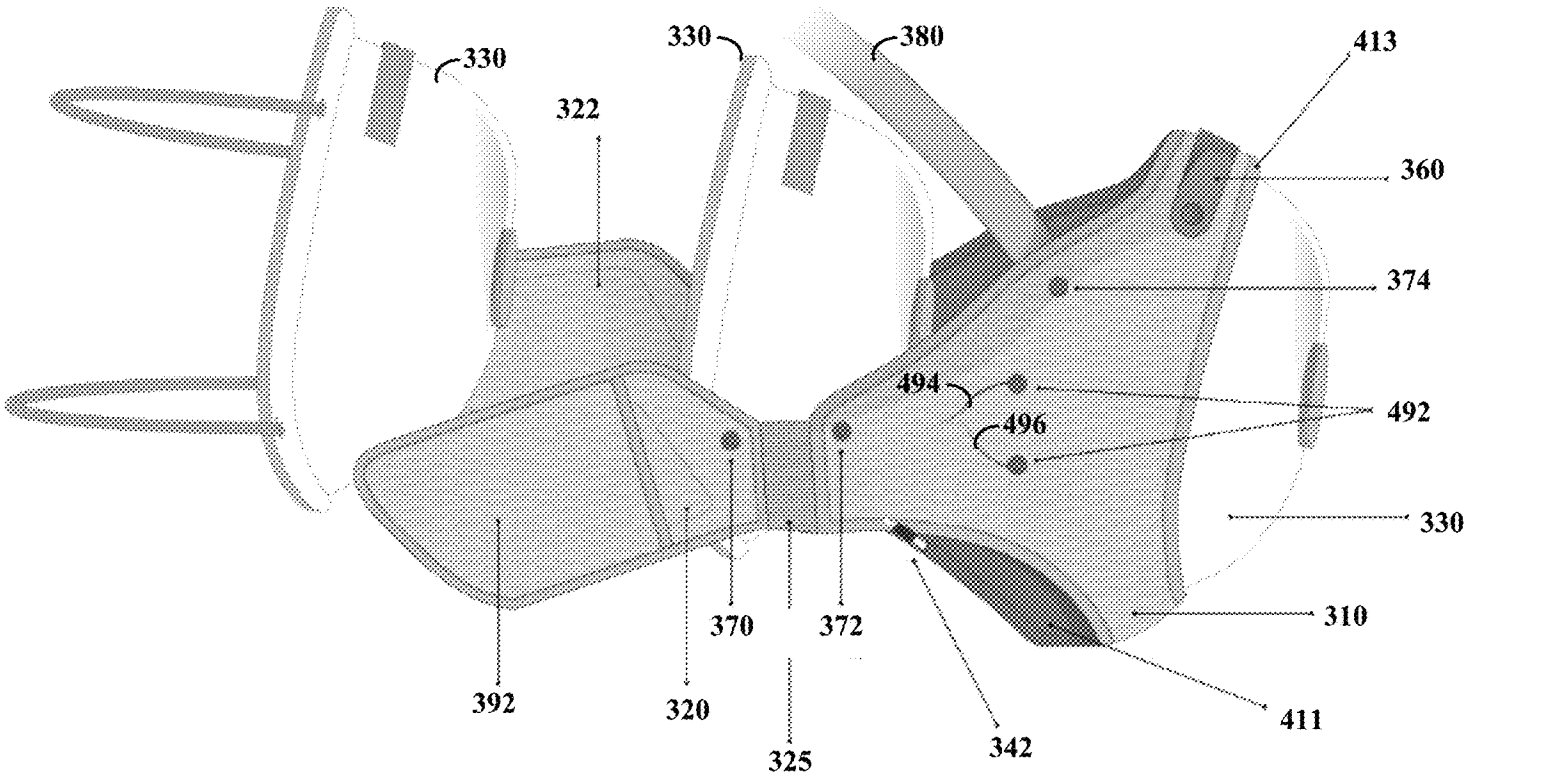
FIG. 4 shows a mask apparatus with insertion of a replaceable mask, in accordance with various embodiments.

FIG. 4 shows a mask apparatus 400 similar to the apparatus 300 shown in FIG. 3, with common reference numerals used to refer to components that may be implemented similarly. FIG. 4 also shows stretchable material 411 (e.g., spandex), an elastic cord 413 (or compression ring) sewn in or otherwise integrated with shell 310, and terminals 492 having wire leads 494 and 496 (shown in a partial cut-away view) coupled to the terminals. These wire leads may, for example, lead back to pouch 392 in which a battery may be placed and coupled (e.g., with an additional battery connector therein and/or with a battery integrated within the mask).

Based upon the above discussion and illustrations, those skilled in the art will readily recognize that various modifications and changes may be made to the various embodiments without strictly following the exemplary embodiments and applications illustrated and described herein. For example, various types of materials can be used, in addition to and/or in alternative to those listed. Strap placement may vary to accommodate different anatomies. In addition, the various embodiments described herein may be combined in certain embodiments, and various aspects of individual embodiments may be implemented as separate embodiments. The embodiments shown in the figures and/or as described herein may be implemented together, or certain components characterized with particular embodiments may be used separately. Such modifications do not depart from the true spirit and scope of various aspects of the invention, including aspects set forth in the claims.

What is claimed is:

1. An apparatus comprising:

a shell having an inner perimeter and an outer perimeter that are continuous and that define elongated regions on opposing sides of the shell and narrow regions at opposing upper and lower sections of the shell, the inner perimeter defining an opening in the shell, and the elongated and narrow regions being of a single component; and a strap, offset from the elongated regions and connected to the elongated regions by a fastener that is connected to both the strap and the shell, the strap and fastener being configured and arranged to secure the shell to a user's face by applying a securing force to the shell in a direction toward the user's face, the inner perimeter having an elastic material configured to seal a filter to the user's face by conforming the filter to contours of the user's face in response to the securing force.

2. The apparatus of claim 1, wherein:

the shell is configured and arranged to conform to the user's face with the inner perimeter extending around the user's nose and mouth, with the narrow region at the upper section extending over the user's nose, and with the narrow region at the lower section extending under the user's chin, and with the elongated regions terminating on a side of the user's head; and the fastener includes a material that is different than the strap and is connected to the elongated regions adjacent the side of the user's head and configured to translate the securing force from the strap to the elongated regions at the side of the user's head.

3. The apparatus of claim 1, wherein the distance between the inner and outer perimeters at the elongated regions is at least twice the distance between the inner and outer perimeters at the narrow regions.

4. The apparatus of claim 1, wherein the elongated regions have a triangular shape and the narrow regions have a rectangular shape.

5. The apparatus of claim 1, further including a snap fastener coupled to the shell.

6. The apparatus of claim 1, wherein the shell is configured to distribute pressure applied to the user's face along the inner perimeter.

7. The apparatus of claim 1, wherein the strap includes multiple straps configured and arranged to secure the shell to the user's face by extending around the user's head to apply the securing force.

8. The apparatus of claim 1, wherein the fastener is coupled to the elongated regions adjacent the outer perimeter.

9. The apparatus of claim 1, wherein the shell includes a nosepiece coupled to the narrow region at the upper section, the nosepiece being configured to stiffen the shell and secure the shell to a bridge of the user's nose.

10. The apparatus of claim 1, further including a shroud coupled to the lower section and configured to extend under the user's chin.

11. The apparatus of claim 10, wherein the shroud includes a stretchable material.

12. The apparatus of claim 10, further including an elastic material, configured and arranged to facilitate a seal around the user's chin.

13. The apparatus of claim 1, wherein the elongated and narrow regions of the single component have an uninterrupted surface area bound by the continuous inner and outer perimeters of the shell.

14. An apparatus of comprising:

a shell having an inner perimeter and an outer perimeter that are continuous and that define elongated regions on opposing sides of the shell and narrow regions at opposing upper and lower sections of the shell, the inner perimeter defining an opening in the shell, and the elongated and narrow regions being of a single component;

a strap, offset from the elongated regions and connected to the elongated regions by a fastener, the strap and fastener being configured and arranged to secure the shell to a user's face by applying a securing force to the shell in a direction toward the user's face; and a filter, wherein the shell, strap and fastener are configured and arranged with the filter to, with the filter positioned between the shell and the user's face, secure the filter to the user's face with an exposed portion of the filter being exposed through the opening and covering the user's nose and mouth.

15. The apparatus of claim 14, wherein the shell, strap and fastener are configured and arranged to seal the filter around the user's nose and mouth by applying a securing force to the filter around the inner perimeter and in a direction toward the user's face.

16. The apparatus of claim 14, wherein the shell is configured with the strap and fastener to apply a sealing force upon the filter along the inner perimeter of the shell.

17. The apparatus of claim 14, wherein the shell includes a nosepiece coupled to the narrow region at the upper section, the nosepiece being configured to stiffen the shell and secure the shell and filter to a bridge of the user's nose.

18. The apparatus of claim 14, wherein the filter has an outer perimeter, and wherein the inner perimeter of the shell extends along the outer perimeter of the filter, with the filter conformed to the user's face and covering the user's nose and mouth, when in use.

19. The apparatus of claim 14, wherein the inner perimeter of the shell has an elastic material configured and arranged to seal the filter to the user's face by conforming the filter to contours of the user's face in response to force applied to the shell by the fastener.

20. The apparatus of claim 19, wherein the elastic material is configured to distribute pressure along the contours of the user's face.

21. An apparatus comprising:

a shell having an inner perimeter and an outer perimeter that are continuous and that define elongated regions on opposing sides of the shell and narrow regions at opposing upper and lower sections of the shell, the inner perimeter defining an opening in the shell, and the elongated and narrow regions being of a single component; and a strap, offset from the elongated regions and connected to the elongated regions by a fastener, the strap and fastener being configured and arranged to secure the shell to a user's face by applying a securing force to the shell in a direction toward the user's face, the fastener having a first end connected to the shell adjacent the outer perimeter and having a second end extending away from the shell and connected to the strap, offsetting the strap from the shell.

* * * * *